US009840403B2

(12) United States Patent
Iotti

(10) Patent No.: US 9,840,403 B2
(45) Date of Patent: Dec. 12, 2017

(54) LATERAL STABILITY SYSTEM

(71) Applicant: MANITOU ITALIA S.R.L., Castelfranco Emilia (IT)

(72) Inventor: Marco Iotti, Reggio Emilia (IT)

(73) Assignee: MANITOU ITALIA S.R.L., Castelfranco Emilia (IT)

( * ) Notice: Subject to any disclaimer, the term of this patent is extended or adjusted under 35 U.S.C. 154(b) by 0 days.

(21) Appl. No.: 14/808,877

(22) Filed: Jul. 24, 2015

(65) Prior Publication Data

US 2016/0031690 A1 Feb. 4, 2016

(30) Foreign Application Priority Data

Aug. 4, 2014 (IT) ..... MO2014A0232

(51) Int. Cl.

| | |
|---|---|
| ***B66F 17/00*** | (2006.01) |
| ***B66F 9/065*** | (2006.01) |
| ***B66F 9/14*** | (2006.01) |
| ***B66F 9/24*** | (2006.01) |
| *B66F 9/075* | (2006.01) |

(52) U.S. Cl.

CPC ..... *B66F 17/003* (2013.01); *B66F 9/0655* (2013.01); *B66F 9/148* (2013.01); *B66F 9/24* (2013.01); *B66F 9/07559* (2013.01)

(58) Field of Classification Search

None

See application file for complete search history.

(56) References Cited

U.S. PATENT DOCUMENTS

| | | | | |
|---|---|---|---|---|
| RE32,366 | E * | 3/1987 | Garber | B66C 23/905 212/278 |
| 8,333,520 | B1 * | 12/2012 | Cronin | B66F 11/048 352/243 |
| 8,540,438 | B1 * | 9/2013 | Cronin | B66F 11/048 396/428 |
| 9,272,884 | B2 * | 3/2016 | Husson | B66C 23/708 |
| 2003/0060923 | A1 | 3/2003 | Scotese | |
| 2004/0120800 | A1 * | 6/2004 | Litchfield | E02F 9/24 414/699 |
| 2004/0131458 | A1 * | 7/2004 | Litchfield | B66C 23/80 414/680 |
| 2004/0262078 | A1 * | 12/2004 | Bailey | B66F 17/006 182/2.1 |
| 2006/0103336 | A1 | 5/2006 | Brooks et al. | |

(Continued)

FOREIGN PATENT DOCUMENTS

| | | |
|---|---|---|
| FR | 2 750 971 A1 | 1/1998 |
| GB | 2 390 595 A | 1/2004 |

*Primary Examiner* — Thomas G Black
*Assistant Examiner* — Demetra Smith-Stewart
(74) *Attorney, Agent, or Firm* — Pearne & Gordon LLP

(57) ABSTRACT

A lateral stability system for a telescopic handler (1), whose telescopic boom (11) is fitted with equipment (12) suitable for lateral translation of a load (10), comprising a processing unit which includes at least a first enabling module, configured to enable or inhibit movements of said boom (11), according to one or more safety parameters.

The system comprises first sensing means for determining the position of the load (10) relative to a center plane (M) of said equipment (12), connected to the processing unit, wherein a first safety parameter is a function of a value of an imbalance signal produced by the first sensing means.

15 Claims, 2 Drawing Sheets

(56) References Cited

U.S. PATENT DOCUMENTS

| | | | | |
|---|---|---|---|---|
| 2006/0180563 | A1* | 8/2006 | Knight | B66C 23/90 212/299 |
| 2006/0232025 | A1 | 10/2006 | Braud | |
| 2008/0019815 | A1* | 1/2008 | Harris | B66C 23/80 414/563 |
| 2012/0039696 | A1 | 2/2012 | Brooks et al. | |
| 2012/0085723 | A1* | 4/2012 | Willim | B66C 23/72 212/350 |
| 2015/0027789 | A1* | 1/2015 | Ellis | B66F 9/065 177/1 |
| 2016/0236922 | A1* | 8/2016 | Merlo | B66F 9/07559 |
| 2017/0130429 | A1* | 5/2017 | Lafrenier | E02F 9/26 |

* cited by examiner

LATERAL STABILITY SYSTEM

The invention has for an object a lateral stability system for telescopic handlers or other similar machines.

In particular, though not exclusively, the invention relates to a lateral stability system intended for the so-called "fixed" telescopic handlers, i.e. telescopic handlers with fixed (non-rotating) platform.

In the field of telescopic handlers there are known front stability systems. Such systems comprise measuring means of the load which is carried by the equipment mounted on the telescopic boom, as well as measuring means for measuring the inclination of said boom.

Depending on the configuration of the machine, a diagram or load table can be obtained which determines all movements allowed by the telescopic boom according to the load supported, without any risk of incurring in a vehicle front tipping.

Indeed it is known that, the higher are the load and the inclination of the arm, the higher is the risk of tipping.

By comparing the signals of said measuring means moment by moment or at programmed intervals, a processing unit on board of the handler allows or inhibits the movements of the boom required by the operator via the controls located in the cab.

However, some equipment, such as the forks, which are mounted at the distal end of the telescopic boom, are able to slide laterally relative to the vertical plane in which said boom is lying, which vertical plane is hereinafter referred to as center plane; owing to said lateral sliding, the forks are enabled to be brought into the working position thereof, without the need for complicated driving maneuvers.

In practice it was found that, once the load has been deposited onto the forks, at the time when the center of the latter is significantly distant from the center plane, the front tire on the vehicle side towards which the load is moved, may be solicited beyond the load indices allowed by homologation.

If the vehicle is moving under the conditions described above, a tipping thereof cannot in principle be excluded.

If, on the other hand, the vehicle is stabilized, the above imbalance conditions may lead to a structural collapse of the stabilizers which are placed on the most heavily loaded side.

The technical object of the present invention is therefore to provide a lateral stability system which is able to overcome the drawbacks of the prior art.

This object is achieved by the lateral stability system in accordance with claim 1, by the stability method implemented according to claim 11 and by the program realized according to claim 13.

Further characteristics and advantages of the present invention will become more apparent from the indicative, and therefore non-limiting, description of a preferred but non-exclusive embodiment of a lateral stability system according to the invention, as illustrated in the accompanying tables of drawings wherein:

FIG. 4 is a load diagram of a telescopic handler of the type to which the invention is destined for.

Figure 1:
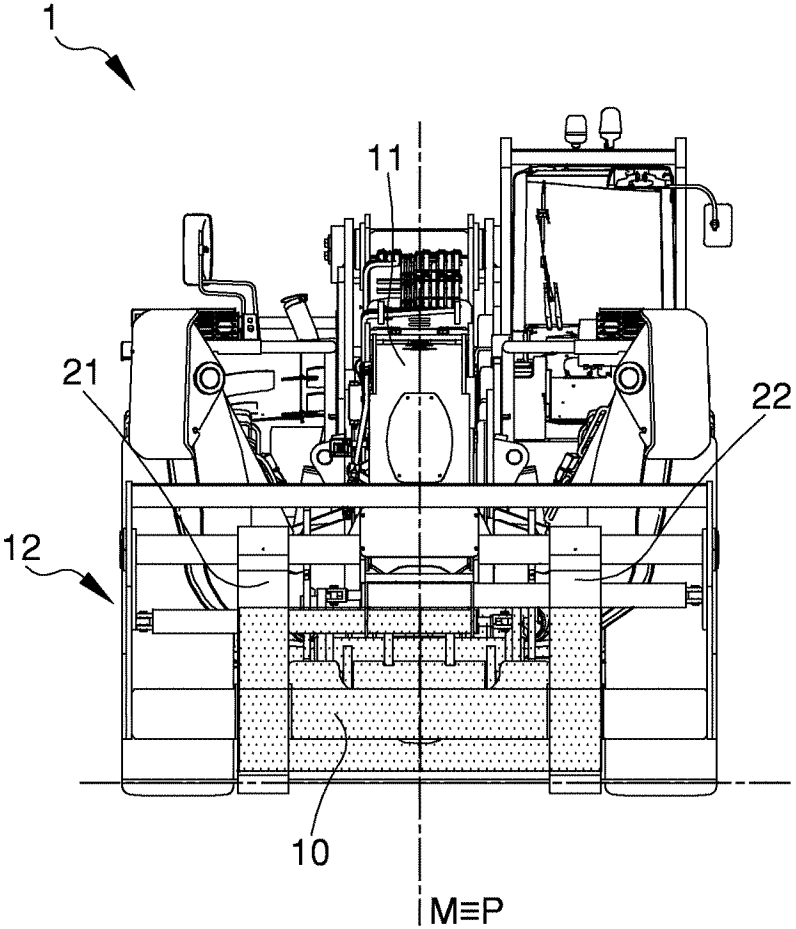
FIG. 1 is a front view of a telescopic handler, whereon the object of the invention can be used in a first operating stage thereof, in which the load is centered.

With reference to the attached FIG. 1, it is indicated by 1 a telescopic handler to which the lateral stability system of the invention can be intended for.

In detail, although the application of the proposed system will be described hereinafter with reference to a telescopic handler 1 provided with a fixed boom 11, particularly provided with an equipment 12, supplied with load forks 21, 22, the invention may be applied to any other lifting equipment.

Figure 2:
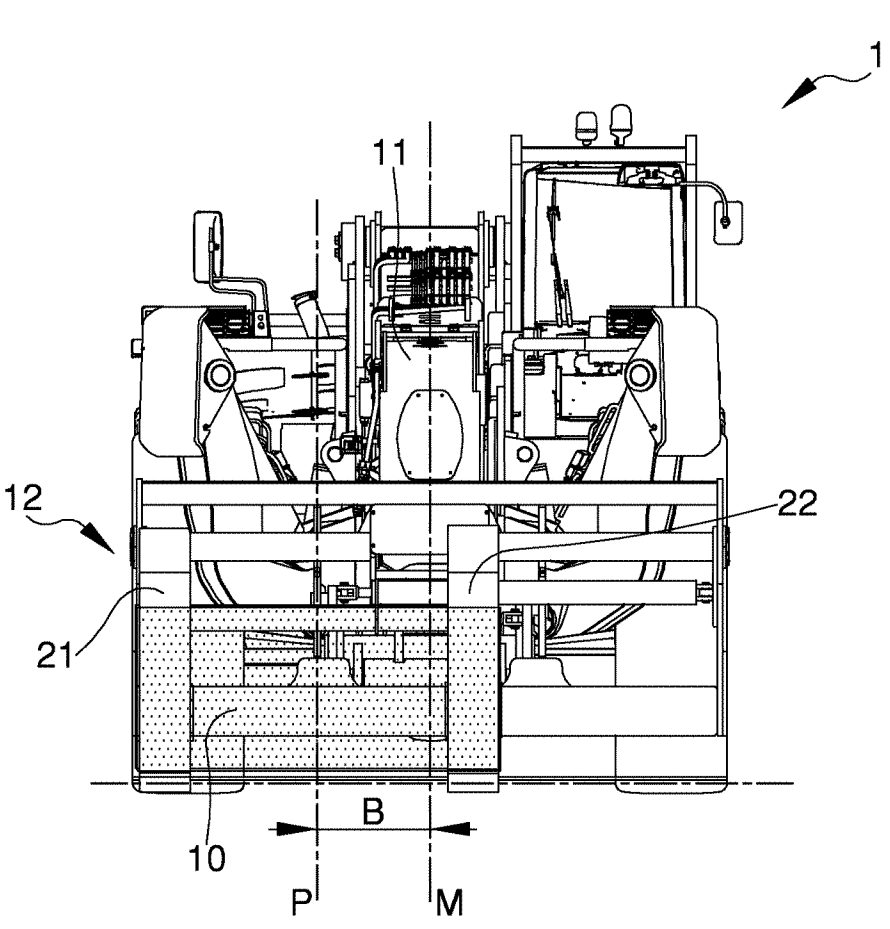
FIG. 2 shows the preceding figure wherein the load is decentralized.

The handler 1 comprises a support frame, movable on wheels, whereon a telescopic boom 11 is mounted via a rotatable coupling, which telescopic boom 11 bears an equipment 12 at distal end thereof, being the latter suitable for laterally translating a load 10 (illustrated semi-transparent in FIGS. 1 and 2, to more clearly show the equipment).

Such equipment 12 can comprise, by way of example, forks which preferably exhibit tines 21, 22, being independently movable by means of suitable actuators 23, 24, such as for example hydraulic cylinders or jacks. In this case, where the actuators 23, 24 move synchronously, a lateral movement of the forks 21, 22 is obtained, whilst, if the former move asynchronously, a mutual narrowing or widening of the tines 21, 22 occurs.

In detail, the machine 1 can comprise at least one actuator for lifting the telescopic boom 11, at least one actuator for extending said boom 11 and, preferably, at least one actuator for the tilting movement of the equipment 12.

Figure 3:
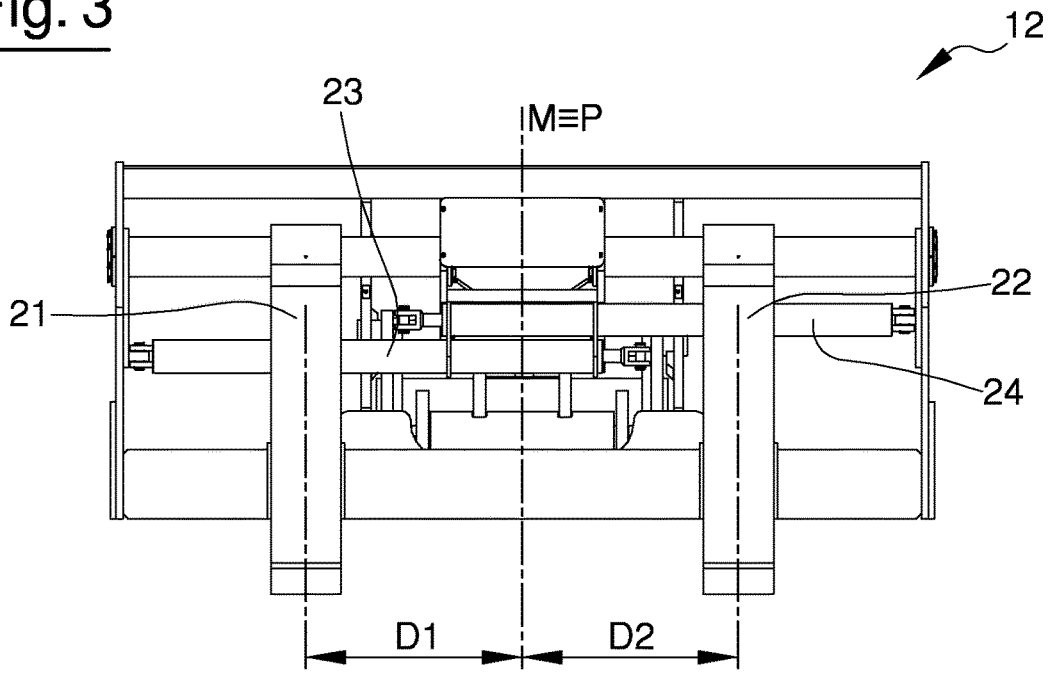
FIG. 3 is a front view of the equipment mounted on the machine of the preceding figures.

The width of the translation performed by the equipment 12 has as a reference the center plane M, which in practice separates said equipment 12 (see FIG. 3) into two halves.

When the forks 21, 22 are in the central position thereof, the equipment 12 is substantially symmetrical relative to the center plane M, which is preferably the vertical plane wherein the telescopic boom 11 is lying and corresponds substantially to the center plane M of the entire handler 1 (see FIGS. 1 and 2).

This type of handler 1 can also include adjusting means, preferably of the hydraulic type, of the frame positioning, which adjusting means enable to adjust the frame horizontality; for the sake of clarity, said adjusting means will be termed hereinafter leveling means.

As will be explained in more detail below, said positioning can be adjusted manually or automatically with the aid of the inventive components.

The lateral stability system herein provided, comprises at least one processing unit, preferably arranged onboard the handler 1, which in turn comprises at least a first enabling module, configured for enabling or inhibiting at least the movements of the telescopic boom 11, on the basis of at least one safety parameter.

In detail, said enabling or inhibiting operations can be actuated by acting on suitable controls this type of machines are provided with, via which the several actuators and hydraulic means described above are controlled.

Broadly speaking, it should be appreciated that, in the present description, the processing unit is described as divided into distinct functional modules only for the purpose of describing functionality thereof in a clear and complete manner.

In practice, such a processing unit may be constituted by a single electronic device, also of the type these machines are commonly provided with, suitably programmed to perform the functions as above described; the different modules may correspond to hardware and/or software routines entities included within the programmed device.

Alternatively or in addition, such functions may be performed by a plurality of electronic devices on which aforesaid functional modules can be distributed.

The processing unit may generally execute the instructions contained in memory modules with the aid of one or more microprocessors and the above functional modules may be further distributed on a plurality of local or remote computers according to the networking architecture wherein the same are contained.

According to an important aspect of the invention, the system includes first sensing means, connected to said processing unit, and suitable for determining the lateral position of the load 10 relative to said center plane M.

Said first sensing means are designed to produce an output imbalance signal, which is a function of the position of the load 10, wherein said first parameter is a function of (or is constituted by) the value of such imbalance signal.

The first sensing means may include, by way of a non-limiting example, positioning sensors embedded within above actuators 23, 24 which move the tines 21, 22 of the fork thereby sensing the corresponding cylinder position; however, one can also provide use of optical sensors or the like. In the preferred embodiment of the invention, the proposed system further comprises second sensing means connected to said processing unit and suitable for sensing the weight of the load 10 supported by said equipment 12.

In this case, the enabling module also acts on the basis of a second safety parameter which is a function of (or is constituted by) the value of a weight signal generated by the second means.

Said second sensing means may include measuring means able to measure the pressure within the chambers of the lifting cylinders of the telescopic boom 11.

However, embodiments of the invention are possible wherein the weight of the load 10 is measured in a different way.

In a preferred embodiment, the enabling module comprises a first evaluating module, configured to process the first and second parameter moment by moment, so as to calculate the torque acting on the equipment 12, and thus on the machine relative to the load 10.

More in detail, this torque can be calculated by multiplying the weight of the load 10 by the value of the torsion arm B (see FIG. 1), corresponding to the distance between the center of gravity of the load 10 (or of its median center plane, as approximation) and said center plane M.

In other words, a way for calculating the torsion boom B, or in any case an optimal practical approximation, is that of determining the distance between a median plane P passing through the center of the two tines 21, 22, regardless of lateral position thereof, and the repeatedly mentioned mid-plane M.

To do so, the math module of the distance D1, D2 between the two tines 21, 22 is calculated and then divided by two (see FIG. 3), by taking the center plane M as the origin of a reference system with a horizontal axis.

Therefore, in this preferred embodiment of the invention, the enabling module also includes an operating sub-module, herein termed safety module, configured for enabling or inhibiting the movements of the boom 11 based on the value of the torque.

In this case, the safety module may preferably enable only unburdening movements of the load 10, such as for example, a translational movement of the load 10 towards the center plane M and then, once a position was reached, which is classified by the processing unit as non-hazardous, movement of the telescopic boom 11 can also be enabled.

Therefore, by employing the invention herein, it is fully prevented the risk of an overstressing acting only on one side of the machine 1, and particularly on one of the front tires.

In this way, as explained in the description of the prior art, the tires or stabilizers are prevented from being damaged and tilting of the handler 1 as well is totally prevented.

Figure 4:
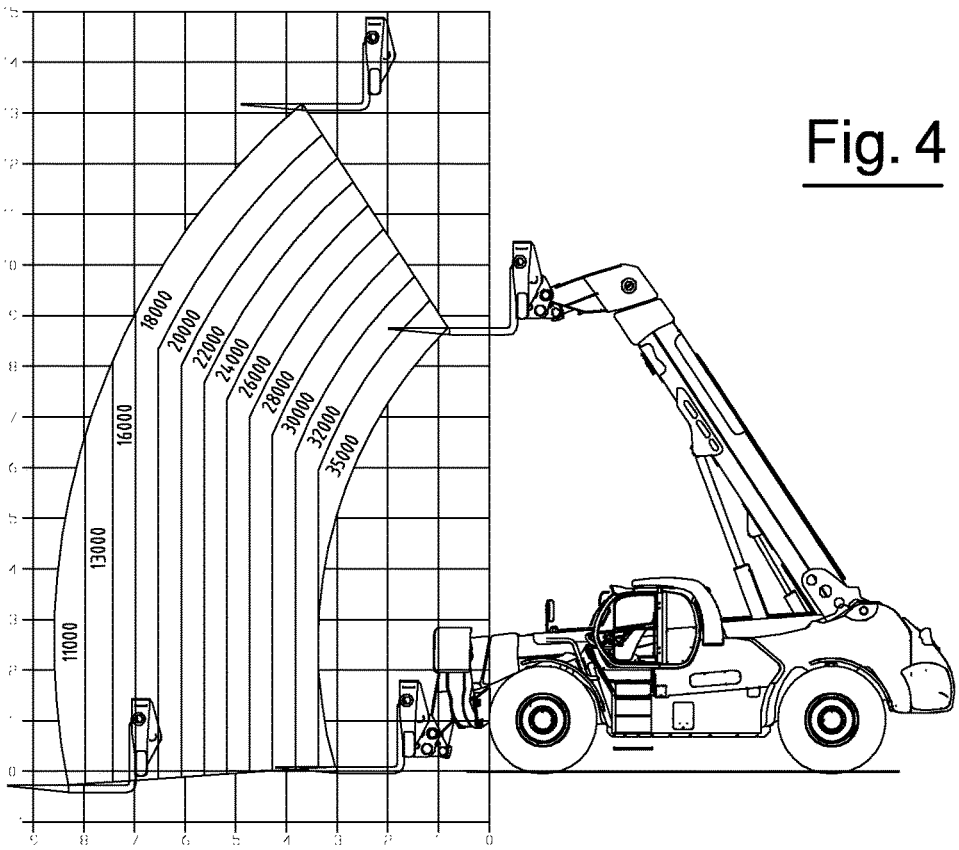

Preferably, the system of the invention integrates or functionally co-operates with a front anti-tilt system of the type adapted to detect a load table such as that represented by way of example in FIG. 4. To this end, the enabling module may be suitable for processing further safety parameters, the nature of which is explained hereafter.

Third sensing means may be provided for determining the angular position of the boom 11 relative to the frame to which the former is rotatably coupled.

Said third means are connected to the processing unit and suitable for producing an inclination signal which is a function of the angular position of the boom 11; for example, such third means may include an angularly-positioned transducer (encoder) or an accelerometer or the like.

In such a case, the enabling module will operate on the basis of a third safety parameter which is a function of (or is constituted by) the value of the inclination signal.

In one embodiment of the invention, the enabling module comprises a further operating sub-module, herein termed second evaluating module, configured to process the second and third parameter, thereby determining spatial positions of the load 10 instant by instant, which are functions of its weight (hereinafter termed "spatial weighed positions" for convenience), which spatial positions do not produce front instability, nor border spatial positions beyond which there is a risk of front instability.

In this case, the above-mentioned safety module is configured to enable or inhibit movements of the boom 11 based on the value of the torque and of the weighed spatial position.

In practice, the safety module checks that both the torque and the weighed spatial position are non-hazardous classified values for the purposes of the side or front stability, and only in the affirmative, said safety module enables the telescopic boom 11 to move.

Where the torque or the weighed spatial position are classified as non-acceptable, then the movement of the boom 11 is inhibited, but not in the unburdening directions, to be intended as weighed spatial positions that less solicit a front instability.

It will be appreciated that all classifications cited in the present description can also be obtained experimentally in accordance with the configuration, weight and conformation of the handler 1, wherein the invention is implemented, as well as in accordance with the sector regulations.

Furthermore, the invention may provide acoustic and/or optical alarm devices available in the driver's cab.

In such a case, when the processing unit detects "limit" situations, i.e. positions of the load which, although not risky, are next to cause unwanted spatial arrangements, said processing unit instructs said alarm device to warn the operator.

Fourth sensing means can be further provided, which are connected to said processing unit, and suitable for determining the extraction amplitude of the telescopic boom 11, i.e. the longitudinal position of the beam which is axially slidable within the boom 11 relative to the sheath or fixed beam. However, said third means can produce an extension signal corresponding to said amplitude, which third means may include a positioning sensor or alternatively an encoder mounted relative to rollers of the known type which are associated to the boom.

In a preferred embodiment, the third means may include an accelerometer.

In this case, the enabling module will operate on the basis of a fourth safety parameter that is a function of (or is constituted by) a value of the extension signal.

In this case, the second evaluating module is configured for processing the second and third parameter, thereby determining, instant by instant, weighed spatial positions which are compared with a table of load 10 such as that of FIG. 4.

In this manner, the processing unit is able to know, moment by moment, whether the load 10 is in a weighed position which does not produce any front instability, or in a weighed boundary position beyond which there is a risk in terms of front instability.

A slope sensing device, such as a so-called "electronic level", can be further provided, which is connected with the processing unit, and suitable for producing a slope detecting signal.

In this case, the processing unit may include a positioning module configured to control said leveling means in accordance with the value of said slope signal.

In detail, the leveling means are suitable for changing or maintaining the positioning of the frame of said handler 1 parallel to the horizon.

Thanks to this advantageous arrangement, the invention is able to further increase the safety of the vehicle 1 stability.

However, the proposed system can also operate on a vehicle provided with manual leveling system instead of a self-leveling automatic system.

As mentioned, the operation of the system provided herein, can be actuated via a computer implemented program, included within the processing unit.

In this case, the program execution actuates a method providing at least the following steps: sensing a first safety parameter, function of the position of the load 10 relative to a center plane M of the equipment 12; and enabling or inhibiting movements of the boom 11 based at least on said first safety parameter.

Preferably, as already explained, the method provides the step of detecting a second safety parameter, which is a function of the weight of the load 10 supported.

In this case, the movements of the telescopic boom 11 are enabled or inhibited on the basis of at least the first and second safety parameters.

The invention claimed is:

1. A telescopic handler comprising a frame, a telescopic boom, an equipment, and a lateral stability system, the frame supporting the telescopic boom, the telescopic handler being configured and adapted to lift and lower the telescopic boom in a vertical plane, the telescopic boom being telescopically extendable and retractable, the telescopic boom having a distal end, the equipment being fitted at the distal end, the equipment being configured and adapted to support a load and to laterally translate the load in a first direction perpendicular to said vertical plane and in a second direction opposite to the first direction, the lateral stability system comprising:

(a) a first sensing means configured for determining a position of said load relative to a center plane of said equipment and for producing an imbalance signal as a function of the position of the load;

(b) a processing unit configured to enable or inhibit movements of said telescopic boom; and (c) a fourth sensing means connected to said processing unit and configured for determining the amount of telescopic extension of said telescopic boom, wherein a fourth safety parameter is a function of the value of a signal produced by said fourth sensing means and said movements of said telescopic boom are further enabled or inhibited according to said fourth safety parameter;

wherein said first sensing means is connected to said processing unit, and wherein said movements of said telescopic boom are enabled or inhibited according to a first safety parameter, said first safety parameter being a function of the value of said imbalance signal produced by said first sensing means.

2. The telescopic handler according to claim 1, wherein said equipment includes a loading fork, whose tines are moved by respective actuators, wherein said first sensing means includes at least one position sensor for each actuator.

3. The telescopic handler according to claim 1, comprising a second sensing means configured for sensing the weight of the load supported by said equipment, the second sensing means being connected to said processing unit, wherein a second safety parameter is a function of the value of a signal produced by said second sensing means and said movements of said telescopic boom are further enabled or inhibited according to said second safety parameter.

4. The telescopic handler according to claim 3, wherein said processing unit is further configured to process the first and second safety parameters and to calculate a torque value, and said movements of said telescopic boom are further enabled or inhibited according to the torque value.

5. The telescopic handler according to claim 4, wherein the processing unit is further configured to process the second safety parameter and to calculate a danger value, and said movements of said telescopic boom are further enabled or inhibited according to the torque and danger values.

6. The telescopic handler according to claim 1, comprising a third sensing means configured for determining the angular position of said telescopic boom relative to the frame, the third sensing means being connected to said processing unit, wherein a third safety parameter is a function of the value of a signal produced by said third sensing means and said movements of said telescopic boom are further enabled or inhibited according to said third safety parameter.

7. The telescopic handler according to claim 1, further comprising at least one slope sensing device connected to said processing unit and configured for producing a slope signal.

8. The telescopic handler according to claim 7, further comprising levelling means configured for changing or maintaining the positioning of the frame relative to the horizon, wherein said processing unit is further configured for controlling said levelling means in accordance with the value of said slope signal.

9. The telescopic handler according to claim 1, wherein the lateral translation of the load is in a direction orthogonal to the direction of extension of the telescopic boom.

10. The telescopic handler according to claim 1, wherein the telescopic boom is fixed such that it cannot rotate around a vertical axis.

11. The telescopic handler according to claim 1, wherein the vertical plane and the center plane are coincident.

12. A method for ensuring the lateral stability of a telescopic handler, the method comprising:

providing a telescopic handler according to claim 1;

sensing the position of the load relative to the center plane of said equipment;

producing an imbalance signal as a function of the position of the load;

determining the first safety parameter as a function of the value of the imbalance signal; and enabling or inhibiting movements of said telescopic boom based at least on said first safety parameter.

13. The method according to claim 12, further comprising:

sensing the weight of the load supported by said equipment;

determining the second safety parameter as a function of the weight of the load, enabling or inhibiting movements of said telescopic boom based at least on the first and second safety parameters.

14. The method according to claim 12, wherein the lateral translation of the load is in a direction orthogonal to the direction of extension of the telescopic boom.

15. A non-transitory computer-readable medium storing instructions that, when executed by a computer, perform the steps of the method according to claim 12.

* * * * *